US010368665B2

(12) United States Patent
Cameron

(10) Patent No.: US 10,368,665 B2
(45) Date of Patent: Aug. 6, 2019

(54) DECORATIVE TRANSPARENT DINNERWARE ARTICLES WITH INTERCHANGEABLE DISPLAY CAPABILITY

(71) Applicant: Deborah Ellis Cameron, Memphis, TN (US)

(72) Inventor: Deborah Ellis Cameron, Memphis, TN (US)

( * ) Notice: Subject to any disclaimer, the term of this patent is extended or adjusted under 35 U.S.C. 154(b) by 0 days.

(21) Appl. No.: 13/715,101

(22) Filed: Dec. 14, 2012

(65) Prior Publication Data

US 2014/0166667 A1 Jun. 19, 2014

(51) Int. Cl.
*A47G 19/02* (2006.01)
*G09F 23/08* (2006.01)

(52) U.S. Cl.
CPC ..... *A47G 19/025* (2013.01); *G09F 23/08* (2013.01); *Y10T 29/49826* (2015.01)

(58) Field of Classification Search
CPC ..... A47G 19/025; A47G 19/04; G09F 23/08; G09F 23/06
USPC ..... 220/574.3, 574; 428/13
See application file for complete search history.

(56) References Cited

U.S. PATENT DOCUMENTS 3,515,262 A * 6/1970 Ornstein et al. ..... 206/217
4,275,518 A * 6/1981 Martin ..... 40/324
4,500,573 A * 2/1985 Piaggi ..... 428/35.7
4,928,411 A 5/1990 Danis et al.
5,047,267 A * 9/1991 Pantaleo et al. ..... 428/13
5,057,344 A * 10/1991 Mealey ..... 428/13
5,560,653 A 10/1996 Beppu
6,401,962 B1 * 6/2002 Littlejohn et al. ..... 220/574
7,093,832 B2 * 8/2006 Parker ..... 273/236
7,163,311 B2 * 1/2007 Kramer ..... 362/154
7,673,753 B1 * 3/2010 Huckert ..... A47G 19/025 206/459.1
2012/0171647 A1 7/2012 Samenuk et al.
2013/0026161 A1 * 1/2013 I ..... H02G 3/088 220/3.8

FOREIGN PATENT DOCUMENTS

WO 02/15757 2/2002

* cited by examiner

*Primary Examiner* — Andrew T Kirsch
*Assistant Examiner* — Don M Anderson
(74) *Attorney, Agent, or Firm* — William S. Parks

(57) ABSTRACT

A unique, versatile system of providing decorative dinnerware articles (plates, bowls, platters, and the like) with viewable designs on demand is provided. Such an article (as well as system) includes at least one transparent top component of a suitable polymer construction that nests with a lower component such that the two connect reliably in a manner that a user may place a decoration of his or her choosing between both component such that the design may be viewed through at least the top component (the lower component may be transparent, as well, if desired). In this way, a user has the capability of utilizing such a nested dinnerware configuration for the purpose of serving food or any other end-use available with such articles while simultaneously providing any desired design that can be displayed through at least the transparent top component.

3 Claims, 11 Drawing Sheets

DECORATIVE TRANSPARENT DINNERWARE ARTICLES WITH INTERCHANGEABLE DISPLAY CAPABILITY

FIELD OF THE INVENTION

This invention pertains to a unique, versatile system of providing decorative dinnerware (plates, bowls, platters, and the like) with viewable designs on demand. Such a system includes at least one transparent top component of a suitable polymer construction that nests with a lower component such that the two connect reliably in a manner that a user may place a decoration of his or her choosing between both components such that the design may be viewed through at least the top component (the lower component may be transparent, as well, if desired). In this way, a user has the capability of utilizing such a nested dinnerware configuration for the purpose of serving food or any other end-use available with such articles while simultaneously providing any desired design that can be displayed through at least the transparent top component. Such a configuration includes the entirety of the two components such that, if desired, the user may actually utilize both components separately or connected together with or without a decorative design attached. The overall method thus allows a user interchangeability of any suitably sized designs (which may be premade or the user may create her own design or designs with properly configured patterns related to the dinnerware shapes and sizes) with the transparent cover components. Multiple articles may be utilized to accord the user the capacity for multiple place settings with similar or different designs presented through such a decorative article system as well. The actual dinnerware designs and thus the capability of providing on-demand designs that may be viewed through such dinnerware articles are also encompassed within this invention.

BACKGROUND OF THE INVENTION

Decorative plates, and other types of dinnerware, have been utilized for many years, either in terms of providing a suitable aesthetic dish on which food is served, or through a plate that is solely utilized for display purposes. Whether such articles were made from china, stone wear, acrylic, paperboard, or any other like material, the primary manner of providing such aesthetic articles was through a permanent appliqué, painted pattern, or other like manner. As such, a user would have been limited to the pattern or other display provided by the manufacturer, or perhaps applied by the dinnerware purchaser prior to actual use. Basically, then, for many years, a user would be limited to purchased patterns without any viable manner of modifying such decorative displays without permanently effecting the look thereof.

These limited alternatives thus required the user to either rely upon the purchased or self-produced decorative plates, etc., for utilization or forced such a user to purchase different plate materials with differing decorative displays in order to accord aesthetic results that would correlate to certain events. In other words, in order to, for instance, provide a set of plates, bowls, etc., that were related to a birthday celebration, a user would purchase pre-decorated plates or permanently self-decorate such dinnerware for that specific event. Likewise, the same user would most likely choose to purchase plates, etc., for different holiday events as well, ranging from appropriate winter holiday motifs (such as for Christmas, New Year's, Hanukkah, and the like) to Thanksgiving and/or fall decorative dinnerware articles, to Independence Day displays. Such varied events would involve different decorative displays; if the user chose to have such different display results with his or her serving plates, and other articles, again, the past availability of decorative alternatives was basically the purchase of such differently decorated materials and articles. As it is, typically, for instance, a parent will purchase cake plates and bowls with certain designs integrated therein for a child's birthday party based on the motif in which such a child is interested (for example, a 4-year boy might want a train display for his decorations; a 4-year old girl may be interested in a "princess" pattern). Each year, as the child grows older, different designs may be necessary as their tastes change, thereby necessitating the purchase of new, differently decorated plates, etc., for such purposes. As well, if the plates and other articles are disposable, such purchases may add to the litter within landfills over time and require continual manufacturing of paperboard products. Although some consumers may enjoy such purchases, others may not wish to purchase new plates, etc., every year and for every different event.

Furthermore, restaurants and other eating establishments may desire to have different decorative plates, platters, bowls, etc., for such yearly events as well, not to mention the ability to provide customized dinnerware for certain patrons on occasion. In order to do so, in the past, it was typically required that different wares be purchased for such purposes, much like described above.

Certain interchangeable decorations have been and continue to be provided to certain degrees in order to overcome the necessity for separate purchases for different events. Unfortunately, however, such alternative decorative plate (and/or another serving piece) display articles and methods are deficient to the level that large-scale replacement of the typical continual purchase standard has not proven viable. For instance, as alluded to above, there are specific "plain" plates and bowls, at least, that have long been offered for initial decoration and then lamination of a proper cover thereafter to allow a user the capability of decorating such articles themselves. These, however, are permanent in terms of the end decorative result; thus, the user would still need to purchase more such wares for decorative purposes if they chose to have sufficient varieties for different events. Additionally, there have been provided certain plates with removable covers on their underside into which photos or other decorations may be placed with a window built into the middle portion of the upper plate (the "well" of the plate that is flat in relation to the concentric inclined portions surrounding such a portion, for instance) for viewing purposes. Such a decoration alternative does provide a certain degree of versatility to a user in terms of the types of photos/displays that may be introduced within the viewing window in relation to a event. However, such a display alternative is very limited in terms of the amount of decorative display that can be viewed (i.e., limited to the "well" portion of the plate), thus limiting the usefulness thereof. Also, the back cover for such display plates is limited in terms of coverage to the window portion of the upper plate and is not a viable plate or like article itself. Furthermore, there are also full display articles (not serving plates) that include an entire viewing area in an upper plate, but in so doing such a plate provides a bubble portion within such a window that thwarts any utilization as an actual plate itself. As well, the bottom cover thereof is not a plate itself and does not provide a bubble component to match that of the upper plate (i.e., the two components, the "plate" and the cover do no nest together).

In essence, the prior art in the decorative dinnerware industry is rather limited in scope to individual viewing window results, sole display alternatives, and/or the need for purchasing different designs for different events and time frames. There thus exists a noticeable lack of true versatility within the decorative dinnerware art to provide different decorative displays for the entirety of a serving plate on demand and of a temporary, but reliable nature. The provision of a temporary and replaceable design that covers as much as the entirety of a plate that is not only easily viewed and enjoyed aesthetically, but does not interfere or come in contact with any foodstuffs present on such a serving article, and, additionally, allows the user to safely clean the plates involved within a dishwasher or like appliance, has not been accorded within the decorative plate industry to date.

ADVANTAGES AND SUMMARY OF THE INVENTION

A distinct advantage of the inventive display device is that capability to provide interchangeable designs for viewing over the entirety of a subject dinnerware article (such as a plate, for instance). Another advantage is the capability of utilizing the dinnerware device as an actual serving article as well as the further ability to utilize each dinnerware component as an individual serving piece on its own if desired. Yet another advantage of the inventive display system is the capability of a user to introduce any number of different designs therein within the confines of the dinnerware article dimensions entirely. Still another advantage of the inventive system is the inclusion of a suitable pattern device to allow for proper cut-out structures of designs for temporary introduction and securing within for viewing within the overall dinnerware article structure. Still another advantage of the inventive configurations (for plates, bowls, platters, trays, and the like) is the utilization of two nesting components to allow for even weight distribution and suitable surfaces or vessels for placement of solid and/or liquid foodstuffs (or other items) thereon and/or therein during use. Yet another advantage of the inventive system is the strength, dimensional stability, transparency (of at least the top component thereof), and reliable temporary connection between the subject dinnerware components during use and presentment of decorative designs thereby.

Accordingly, this invention encompasses a display article comprising a first upper component and a second lower component, wherein said first and second components are configured to have the same contours for said components to properly nest together upon placement of said upper component on top of said lower component and upon introduction of an insert between said upper and said lower component, wherein said first upper component is constructed of a transparent and resilient polymeric material such that said insert may be properly viewed throughout the entirety of said first upper component when present between said first upper component and said second lower component. Furthermore, such a configuration may also include the limitations wherein said first upper component includes a peripheral edge that extends to a distance that is longer than the peripheral edge distance of said second lower component and wherein said peripheral edge of said first upper component extends to a point below that of the peripheral edge of said second lower component when said first component and said second component are contacted in nesting relation to one another. In such a manner, the upper component accords a pressure capability to retain the lower component when snapped or otherwise attached into place (if desired, the user may also utilize clips or other like implements to keep the two components together). The lower component may include slight indentations, as well, that allow the user to insert an edged tool of some type in order to separate the two components when needed. The overall construction of the two components, however, allows for repeated pressure attachments for the provision of incorporating and introducing different design inserts between the two components on demand without exhibiting any appreciable loss of strength of such pressure-based connections. The method of utilizing such an interchangeable decorative dinnerware system is also encompassed within this invention.

Such a display article thus allows a user to place a suitable insert (such as a cut-out, picture, photograph, or other type of design) between both components thereby permitting a full view of the placed design through the transparent first component. Since the first (upper) component is entirely transparent, and the design may be placed anywhere between the two components, such a system thus allows for secure, stationary placement of any size or shape design that does not extend past the peripheral edge of the first component, thus allowing for full view of the entire design no matter its size or shape within such confines. With the connections present between the upper and lower components (which, again, may involve pressure means, as well as extensions, such as clips, as one example), then, such an article allows a user to utilize such a dinnerware article for carrying, displaying, removing, or otherwise handling foodstuffs thereon and/or therein just as a usual dinnerware article (such as, as examples, plates, bowls, platters, trays, and the like). The lower component may also be made transparent, if desired, in order to permit complete viewing of a design through both nested dinnerware components during use, as well.

As noted above, the types of dinnerware articles that may be utilized within this inventive system include plates (of any size and configuration, such as circular, square, triangular, oval, etc., basically any suitable geometric shape that allows for nested plate components of substantially similar shape; such plates basically include salad plates, dinner plates, serving plates, saucers, and the like), bowls (of any size, depth, and shape, again, as long as the concentric components fit properly together in a reliable manner; such bowls thus would include, without limitation, soup bowls, salad bowls, cereal bowls, serving bowls, and the like), platters and trays (similarly to the plate possibilities, any suitable geometric shape may be utilized for such alternative dinnerware articles), at least. Such dinnerware should be capable, at least, of providing a suitable surface or vessel for serving foodstuffs of all kinds; alternatively, though, such articles may also be utilized solely or in addition to such food serving purposes as display units for informational or decorative purposes, too.

Using plates, then, as examples of the basis of the inventive designs and configurations, the overall system allows for (again, as merely examples of specific types of dinnerware articles, without limitation as bowls, platters, trays, etc., are also encompassed herein, as discussed above) two concentric plates (preferably, though not necessarily circular in shape; again, any geometric shape may be employed, if desired, as long as the upper and lower plates are of substantially the same shape themselves; thus, triangular, ovular, square, rectangular, trapezoidal, basically any shape, may be employed with this invention). For plates, as well as all other possible types of dinnerware contemplated herein, the term "substantially" as it applies to the shape of the upper and lower components indicates that the same basic geometric shape and size is necessary for proper nesting, with the understanding that the lower component will have a different peripheral edge configuration and slight, but very important, contour differences to the top component in order for such nesting to properly occur. Namely, the peripheral edge of the upper plate should be configured to curve downward such that a suitable annular ridge is present that overlaps the peripheral edge of the lower plate when connected together. Such a design thus creates two important characteristics; the first that the upper plate will always cover the top surface of the lower plate to prevent any appreciable movement of foodstuffs or liquids to enter the area between the upper and lower plate during use and while connected. Such an overlapping lip thus allows one manner of introducing the lower plate into a resilient attachment that may be easily undone manually by the user. If desired, however, the upper plate may include extension posts or other like connection means (such as stationary clips that grasp and hold the lower plate upon proper alignment and applied pressure). Thus, the overall two-piece article (not including the design or designs introduced between such upper and lower plates during use for aesthetic effect) must be of proper form to allow the user the capability of carrying and holding foodstuffs on demand without any further need to grip or manually force upper and lower plate connections to remain in place. The configured peripheral edge designs of both plates compensate for such a necessary outcome leaving the user full range of motion during use while simultaneously permitting a suitable view of the pictures, photos, graphics, etc., introduced there between (unless, of course, covered by any food or other items placed on top of the upper plate during actual use).

The two dinnerware components should further exhibit similar overall configurations in order to permit nesting of the upper and lower components to a degree that sufficient space exists between each component to place the desired design inserts(s) as well as properly retain and hold such inserts in place during use. The peripheral edges of the two components would be the only portions of these components in actual contact with one another as the pressure attachment capability is provided in that manner. The interstitial space between such components is thus extremely small, but sufficient to accord the above-noted insert-holding capability. Thus, in essence, such a minimal space (which may be, for instance, from 1 to 20 mils, as an example, in distance between the upper surface of the lower component and the lower surface of the upper component), is sufficient to hold the desired design inserts in place during utilization. Likewise, if pressure were applied to the external surfaces of the two components during use, such a space allows for some degree of movement of the two components towards one another without any deleterious effect. Basically, the capacity for design insert introduction is permitted through the lack of complete contact between the upper and lower components of the overall display article when in use, although such a space is very limited to the extent that such design inserts will not migrate from a set position once properly placed between both components and the component peripheral edges are attached and secured together.

The overall configurations for the two components may be of myriad types (again, with the limitation that such components will nest together with the proper spacing noted above). Plates, for instance, may be of many different structures (beyond the geometric shapes noted above). For instance, most plates will include a "well" portion in the center (for circular plates, such a well would be a centrally located circular recess) with a raised "doughnut"-shaped portion (the "rim") of concentric size and shape leading to the peripheral edge. A slope portion (the "frame") thus connects the doughnut portion to the well portion exhibiting a uniform incline in order to provide the overall and continual symmetry of the plate (particularly if it is circular in nature). Other plates may include a peripheral edge that leads to an impediment-type outer border to prevent food or other items from falling from such a plate if tilted. The border then leads to a wide well portion. Basically, then, plate designs in general may be of any type within this invention with the only requirements being that the upper first plate exhibit complete transparency and that such an upper plate properly nests with its lower plate counterpart and connects therewith to such a lower partner in a reliable and easily detachable fashion upon manual activation.

In this manner, coupled with the connection capability of the two plates, such an overall two-piece article may serve in tandem as a single plate and separately as two distinct plates that may serve substantially the same purpose and perform in the same manner as well. In other words, the two plates would be of substantially the same shape, size, weight, and configuration with the only slight differences in the peripheral edges, as noted above, as well in the angle of the incline of the plates leading from their peripheral edges to a central well portion. Such a specific configuration is unique in the decorative plate industry as prior transparent display techniques have involved central windows within a single upper plate with no lower plate, but a securing cover instead being utilized. The ability for the user to provide a design, picture, photo, etc., throughout the entirety of the upper plate, rather than for a discrete region or area of the plate, has heretofore been unavailable. This unexpectedly effective and good result that allows the user free reign to decorate such an entire plate breadth stretches the aesthetic possibilities for a user beyond all previous attempts. As well, the capability of full decorative effect permit's the utilization of a stencil or outline system that permits exact layouts for certain portions of the transparent plate system, thereby further granting nearly infinite capacity for creative license to the user for such aesthetic purposes.

Therefore, the two plates must be constructed from a suitable material that is transparent, resilient, washable, and sufficiently flexible in order to allow for pressure activation of the connection means between the upper and lower plates, but with the further requirement that peripheral edge attachments will prove reliable (i.e., will not lose dimensional stability and thus lead to disengagement or otherwise undesirable loosening of such connections) during actual use). A standard glass structure, although transparent in nature, would not exhibit the proper flexibility and would also likely be too heavy (particularly with two plates in use simultaneously) for proper use (at least the resiliency of two plates thin enough for proper weight requirements would be too brittle, as well, to meet the criteria). Thus, the plates are preferably made from a suitable polymeric material, preferably a polymer that can meet a certain transparency and low haze level (to allow for proper viewing of the design, picture, photo, etc., introduced between the upper and lower plates during use) as well as the necessary flexibility and dimensional stability to permit the plate-to-plate connection without any need for outside connectors. As such, it was found that polyolefins and polycarbonates provide the best results for such benefits. Linear, low-density polyethylene (LLDP), polypropylene, and polycarbonate, in particular, meet such limitations, while polycarbonate, in particular, provides one potentially preferred embodiment in that manner.

As noted above, such descriptions for plate alternatives with the overall dinnerware possibilities actually provide suitable explanations of the same configuration necessities for the other types of articles encompassed herein within the invention. Thus, in terms of bowls, for example, the same peripheral edge requirements are needed (top component extends over the lower component), the contours of the inclines of both the top and lower components are slightly different to allow for proper nesting, and the overall shape of both components are the same. With a top transparent bowl component, then, a design may be introduced between the top and lower components for viewing throughout the entire top portion. The lower bowl component, however, may also be transparent for total view of the decorative display from any vantage point. The same issues, then, would be in place for platters, trays, and any other like serving article in the dinnerware genre (cake holders, for instance, even deviled egg and other like differently shaped articles may be configured in such a manner to permit such a removable and reusable decorative display, if desired). As long as the proper peripheral edge requirements are followed (to permit, again, proper connection between the top and lower components), as well as the necessary difference in inclines between the top and lower components for substantial nesting provisions between the two, then such dinnerware articles meet the limitations of the inventive system.

Thus, the actual design inserts that may be introduced between the upper and lower components of the inventive dinnerware articles may be of any type as long as they are of a substance that will be properly retained in a stable form and sufficiently flat to permit placement and secured retention within the space between the upper component and lower component when they are properly connected together. Thus, solid forms of any type (again, with the proper flat characteristics), beads, even possibly properly encased liquids (such as flat sachets of colored fluids, as one example), colored sand or other like particulate material that may form an aesthetic pattern, and even free flowing colored liquids, basically, again, any substance that may fit within the space between the two components for display purposes and that may be retained therein during use. With, for instance, bowl articles, the higher levels of the top portions thereof would more easily hold free flowing (liquid, sand, etc.) materials than the other types of dinnerware articles, certainly. However, the sealed capability of the connections between the peripheral edges of the upper and lower dinnerware components may be sufficient to retain such free flowing materials within the confines of the interstitial space such that utilization of such an alternative design insert is well within the scope of this invention. The term "insert" or "design insert" for this invention thus encompasses any such solid or liquid material for such a purpose.

As more specific, non-limiting examples of such design inserts, paper cut-outs of any type could be utilized, including those to which a user has applied his or her own designs, as long as, again, such cut-outs comply with the size limitations of the components themselves. Thus, the designs may occupy as little or as much of the available area underneath the top component (and thus on top of the lower component) as desired, as long as such a design does not extend beyond the peripheral edges thereof. Furthermore, depending on the type of dinnerware article selected, separate cut-outs may be undertaken of suitable and appropriate designs by the user and placed within the confines of certain spaces associated with the dinnerware article itself. For instance, with a plate article, the user may decide to provide a cut-out that conforms to the size and shape of the well portion, while the doughnut or outer portion (rim) of the plate may includes a separate design, thus allowing for the full expanse of the base display article but with separate designs introduced between the two plate components in such a manner. There is, simply put, no limit to the designs, photographs, pictures, etc., that may be introduced between the two components of the inventive system and article, thus creating the unexpectedly good versatility and effectiveness thereof. Only the user's imagination limits the overall utility of such an article, in other words.

Additionally, supplies of properly shaped design inserts may be provided by outside sources (such as from craft stores) that are specifically formatted for utilization with the inventive display system. As well, a user may also be able to access the Internet to search for proper design inserts in the same manner, if desired. The display article may also be supplied with suitable patterns (or stencils) to allow for proper cut-outs or other like configurations of any number of different material types for utilization with the system, too. Such patterns may be standard in shape for the type of article involved (for instance, formatted to the well and rim of a plate, or the well of a tray, etc.), or other patterns may be provided that do not conform to specific article shapes, yet still allow for configurations that will fit within the confines of the display article when in use (i.e., viewable through the top component and does not exceed the length of the peripheral edge of the top component). Thus, even with the patterns that may be followed to accord suitable cut-outs, etc., for the design inserts, myriad, if not limitless, possibilities exist and fit within the broad scope of this invention.

DETAILED DESCRIPTION OF THE DRAWINGS AND PREFERRED EMBODIMENTS

Without any intention of limiting the scope and breadth of the invention described herein, certain potentially preferred embodiments are presented below in accordance with the drawings in support thereof.

Figure 1:
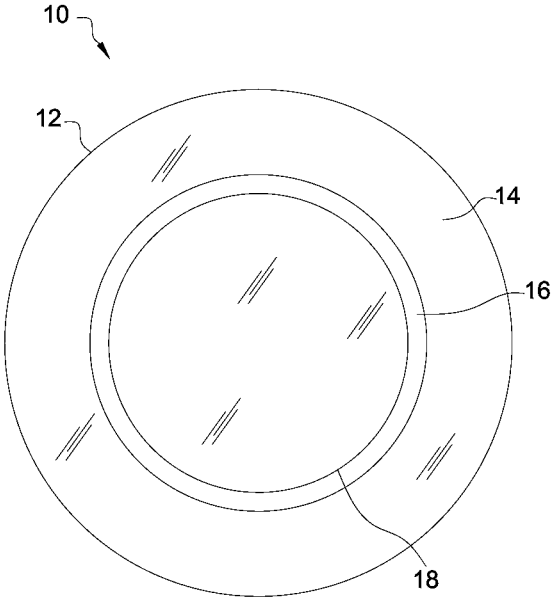
FIG. 1 depicts an aerial view of a first upper plate in accordance with one potential embodiment of the invention.

FIG. 1 thus shows a potentially preferred circularly shaped first upper plate 10 having a peripheral edge 12 a circular flat rim 14 a circular inclined frame 16 leading downward to flat circular well 18. The top plate 10 is preferably made from a polycarbonate material and may be of any proper thickness to permit proper transparency thereof over the entirety of such an upper plate 10 as well as a weight maximum that is sufficiently light to allow for proper carrying by a user in tandem with the second lower plate nested therewith (as in FIG. 9). Thus, a thickness of from 3 millimeters to 8 millimeters would suffice for such a purpose; if the plate were too thin, it would not allow for proper weight bearing during use and if it were too thick, again, the weight and haze level (transparency) would compromise the usefulness and effectiveness of the overall article. The same measurements and materials would be suitable for the second lower plate as well.

Figure 2:
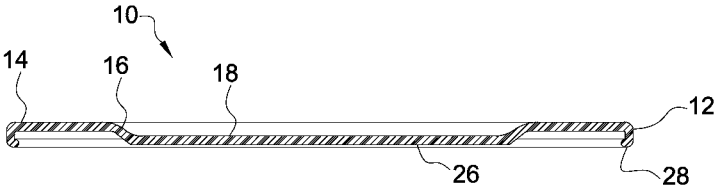
FIG. 2 depicts a cross-sectional view of the first upper plate of FIG. 1.

FIG. 2 thus shows the first upper plate 10 in cross-section with the top surface thereof being the rim 14, the frame 16, and the well (or canvas) 18. The bottom surface 26 mirrors the shapes of the top surface components as well. The peripheral edge 12 includes a downward extending lip 28 as well.

Figure 3:
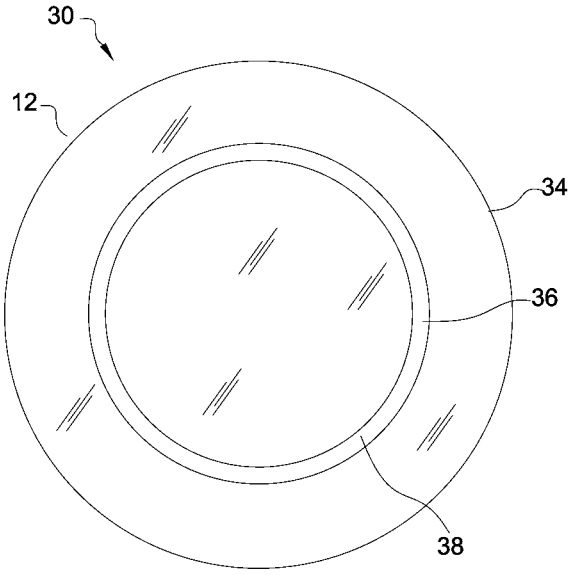
FIG. 3 depicts an aerial view of a second lower plate in accordance with one potential embodiment of the invention.
Figure 4:
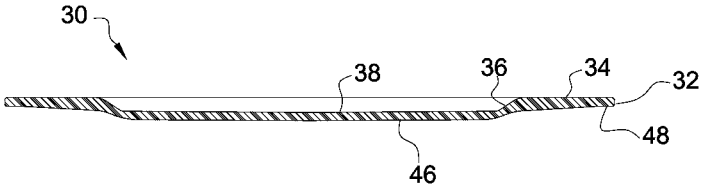
FIG. 4 depicts a cross-sectional view of the second lower plate of FIG. 3.

The second lower plate 30 is shown in FIGS. 3 and 4. As for the upper plate (10 in FIGS. 1 and 2), the lower plate 30 includes a peripheral edge 32, a rim 34, and a frame 36 inclined downward to a well 38. Such components are slightly larger in size, but the same basic shape (circular) as the components of the upper plate to accommodate placement of the upper plate thereon in a suitable nesting relation (as in FIG. 9, for example). "Nesting" as it applies to this invention thus indicates a flush contact between the peripheral edges of both components with very limited space between the bottom surface of the upper plate (26 in FIG. 2) and the top surface components 32, 34, 36, 38 of the lower plate 30 for introduction and placement of the design insert (50, 54 in FIG. 5). Even with the insert present, the two plates will still exhibit a reliable connection through pressure activation and engagement of the extended peripheral edge of the top plate over and around the peripheral edge of the lower plate 30. The lower plate 30 includes a bottom surface 45 which would be in contact with a table or other like article surface if and when the overall article (70 in FIG. 9) were placed thereon. As well, the lower plate peripheral edge 32 includes a flattened lip 47 that fits snugly within the confines of the downward extending lip of the upper plate (28 in FIG. 2), thus providing, in addition to the similar sizes and shapes of the components of both plates, the overall nesting result there between as well as the pressure-activated connection means between both plates during actual utilization to form the display article.

Figure 5:
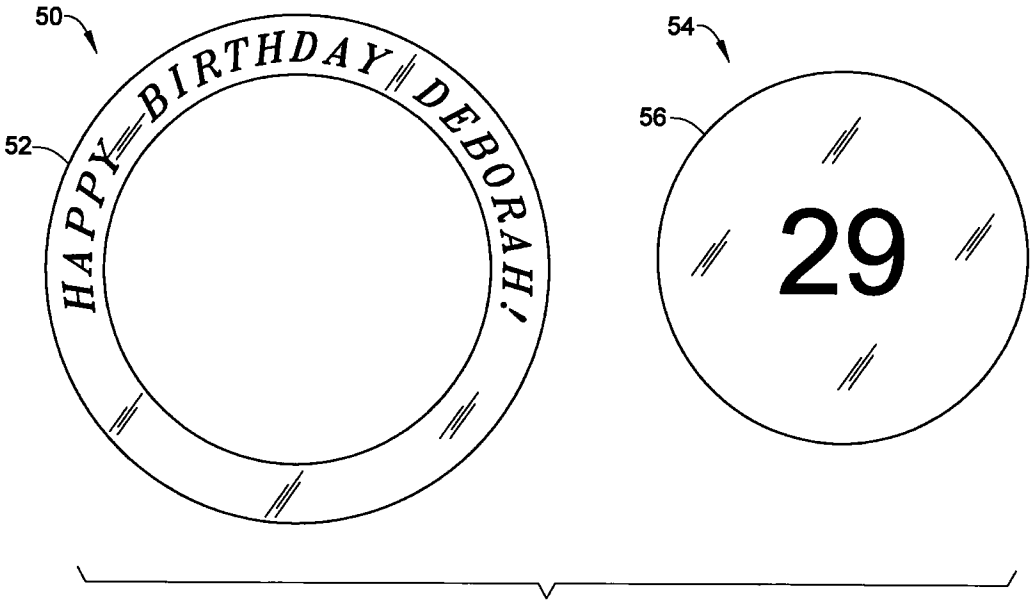
FIG. 5 depicts an aerial view of a rim design and a well design that is provided in relation to a layout in accordance with the configuration and contours of both upper and lower plates of FIGS. 1, 2, 3, and 4.

FIG. 5 provides but one potentially preferred insert (or more suitably described as inserts) 50, 54 for introduction between the upper and lower plates (10 in FIG. 1, 30 in FIG. 3, respectively). As is shown, the user may provide a well cut-out 54 that may be sized appropriately for placement within the well of the lower plate (38 of FIG. 4). In actuality, however, any sized cut-out or insert may be placed within such a well of the lower plate as long as the insert will not create a permanent mark thereon. Thus, a painted material that has sufficiently dried may be applied with a design thereon, a photograph, a drawing, or a pre-printed design on a suitably thin material (such as from 1 to 10 mils in thickness) may be utilized for such a purpose. Actually, the list is myriad for such an insert with the only limitations being the requirement of non-permanency to allow for other designs to be implemented in a like temporary fashion, a size and shape that does not extend beyond the peripheral edges of both plates, and, again, a thin enough structure to allow for sufficient contact between the connection means of the upper and lower plates during use. A second doughnut-shaped insert 50 is provided to fit the shape of the rim of the lower plate (34 of FIG. 4). Messages of any type, as well as types of designs, motifs, photographs, the list, again, goes on, may be placed on such an insert as well (the same holds true for any insert type, such as that presented as covering a well, above 54). As described above, as well, such an insert may be of any solid or liquid that provides a design capability (whether static or changing during use; for example, colored liquids may be flow within the confines of the interstitial space between the two components to form changing designs during actual use). In any event, the same limitations as to insert structure, size (or volume) and shape, thickness, and non-permanency hold true for this type of insert as described above as well. In this instance, two separate inserts 50, 54 are prepared for utilization with the plate combination (70 of FIG. 9), with the rim-shaped insert 50 including an outer peripheral edge 52 and an inner peripheral edge 53. The well-shaped insert 54 includes its own outer peripheral edge 56. Importantly, again, such an insert example is but one type that may be utilized for the inventive display article. With a plate having a rim, frame, and well configuration, such inserts work well for full viewing through the utilization of cut-outs that cover the entirety of the lower plate surfaces (and thus provide a complete view of the overall insert design once the upper plate is placed thereon the lower plate and connected thereto). However, if desired, cut-outs or photos or any other such design material that only partially covers the top surfaces of the lower plate may be utilized as well. Likewise, if the plates are not of the same configuration as presented here in non-limiting fashion (i.e., rim, frame, and well configurations), but have peripheral edges that are thinner and rims that are far shorter and not flat, and thus, include a far larger well, then inserts of any size and shape that meet the limitations defined above may be utilized therewith as well (in other words, the embodiment presented here is not the only plate configuration that may be employed within the scope of this invention). Furthermore, if the plates are not circular, but another geometric shape, then such inserts may be, again, of any suitable size and shape to permit proper nesting and connection between the two plates, are, again, non-permanent in nature, and, lastly, do not extend beyond the peripheral edges of the upper plate. The inserts may be on any type of paper or other suitable material that are sufficiently thin and may or may not include designs applied thereto or integrated therein (as noted above, the types of materials that may utilized as the insert is myriad and only requires the capability of being properly retained between the two components during nesting use; as it is, if desired, the insert may also be of a movable type of substance that the user may cause to maneuver between the two components through manipulation of the overall connected article since the pressure-activated connections of the peripheral edges should prevent any external loss of such materials in that manner; again, the potential for an insert of any type is extremely broad and thus contemplated within this invention). In terms of paper products that may be utilized are magazine paper, newspaper, construction paper, standard bond paper, and the like, as merely some potentially preferred materials, rather than providing any limitation through such a description. For FIGS. 5, 6, and 7, the designs utilized are on standard construction paper and include the message "HAPPY BIRTHDAY DEBORAH" in the rim-shaped insert 50 and "29" in the well-shaped insert 54, thus indicating, in this non-limiting instance, a birthday celebration for a person turning a certain age. It goes without saying, again, that any type of message presented in any manner that meets the limitations of the insert described above may be utilized in conjunction with this overall display article.

Figure 6:
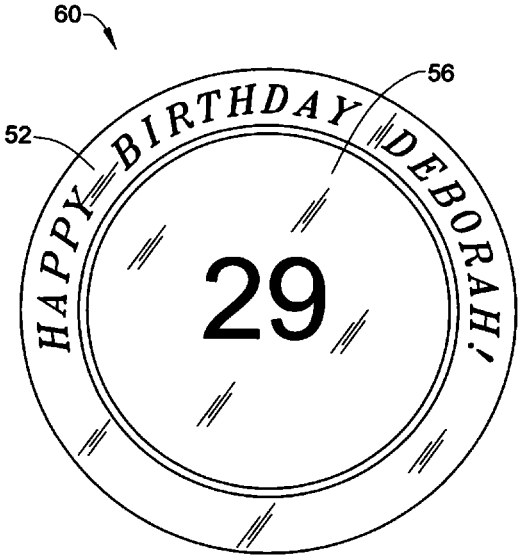
FIG. 6 shows the design of FIG. 5 placed onto the lower plate of FIG. 2.

FIG. 6 thus shows the aerial view of the inserts 50, 54 placed onto the second lower plate (30 of FIG. 4). The well-shaped insert 54 is placed onto the well (38 of FIG. 4) of the second lower plate and the rim-shaped insert 50 is placed on the rim (34 of FIG. 4) of the second lower plate. After such placement, the well-shaped insert's peripheral edge 56 is in contact with the inner peripheral edge 53 of the rim-shaped insert 50. The outer peripheral edge 52 of the rim-shaped insert 50 is thus extended to a point just short of (or, if desired, such may be actually introduced within the curved area of the upper component's peripheral edge) the peripheral edge (32 of FIG. 4) of the second lower plate (30 of FIG. 4). The resultant insert-covered lower plate 60 is thus ready for placement of the upper plate (10 in FIG. 1).

Figure 7:
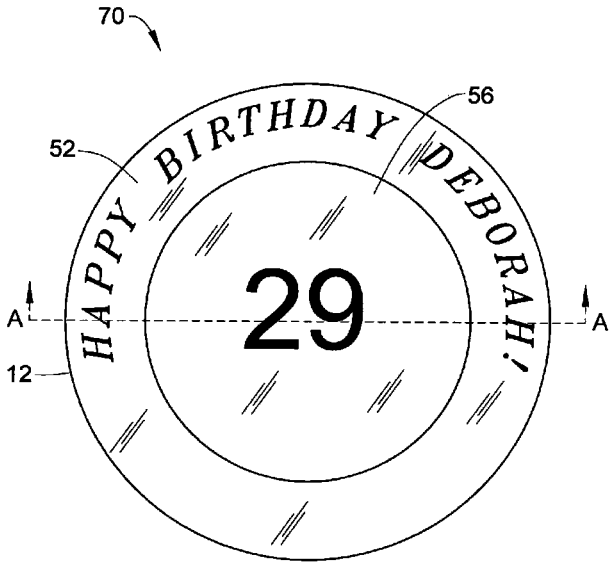
FIG. 7 shows the placement of the upper plate of FIG. 1 onto the resultant plate design of FIG. 6.

FIG. 7 thus shows the placement of the upper plate in such a fashion with the upper plate rim 14 covering the rim-shaped insert 50 and the upper plate well 18 covering the well-shaped insert 54. The upper plate peripheral edge 12 thus extends beyond the insert outer peripheral edge (52 of FIG. 5) and can surround the lower plate peripheral edge 52 in order to connect both plates together through pressure application. In this manner, the transparent nature of the upper plate (10 of FIG. 1) allows for full viewing of the insert designs 50, 54 there through and the entire connected article 70 may also be utilized for any standard plate purpose (food serving, for example).

Figure 8:
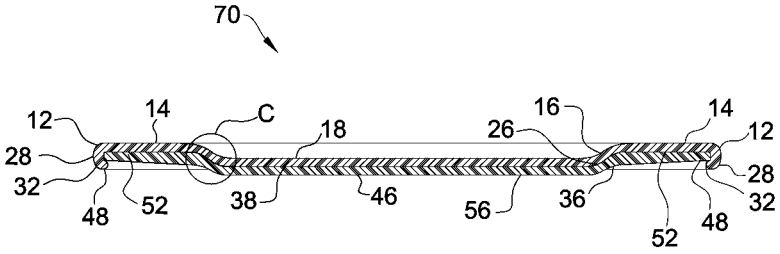
FIG. 8 shows a cross-sectional view of the nesting of the upper plate and the lower plate along line A-A from FIG. 7.

FIG. 8 shows the cross-sectional view of the connected article 70 through the line A-A provided in FIG. 7. With this depiction, it is seen how the first upper plate 10 has exposed its peripheral edge 12, rim 14, frame 16, and well 18, and covering both the insert (50, 54 of FIG. 7) and the second lower plate 30. The lower plate 30 includes, as well, its own peripheral edge 32, rim 34, frame 36, and well 38 that are properly nested with the upper plate 10. Thus, the bottom surface 26 of the upper plate 10 is in contact with the insert (50, 54 of FIG. 7) which is covering the top surfaces 34, 36, 38 of the lower plate 30. The bottom surface 46 of the lower plate 30 is thus available for placement on a suitable surface itself. The combination article 70 further shows the overlapping of the downward extending lip 28 of the upper plate 10 over the flattened lip 48 of the lower plate 30 to permit connection there between and prevention of food or liquid from entering the area between the two plates within which the insert 50, 54 is present. In this manner, the insert 50, 54 may be removed and used again with the same display article without any introduction of potentially destructive or otherwise harmful liquids, etc., during use. Furthermore, the connections being pressure applied are easily undone through suitable opposite pressure application to allow for removal of the inserts and subsequent cleaning of the two plates and reuse thereof with the same or a different insert or inserts on demand.

Figure 9:
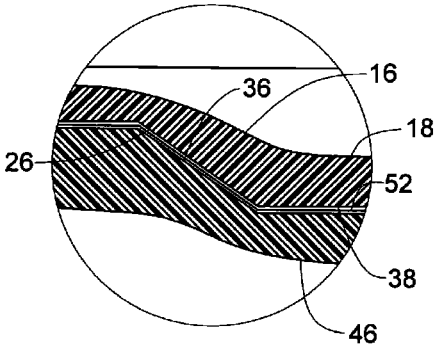
FIG. 9 shows a close-up view of the nested portion C of the upper plate and the lower plate from FIG. 8.

FIG. 9 thus shows a closer view of the interface between the upper plate 10 and the lower plate 30 at each frame 16, 36. Since the upper plate 10 will be situated and placed atop the lower plate 30, the incline angle of the upper frame 16 will be slightly higher than that of the lower frame 36, in order to accommodate the nesting relation of the two plates 10, 30 together.

Figure 10:
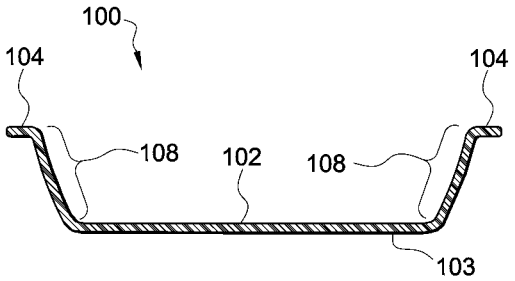
FIG. 10 depicts a cross-sectional view of a second lower bowl in accordance with one potential embodiment of the invention.
Figure 11:
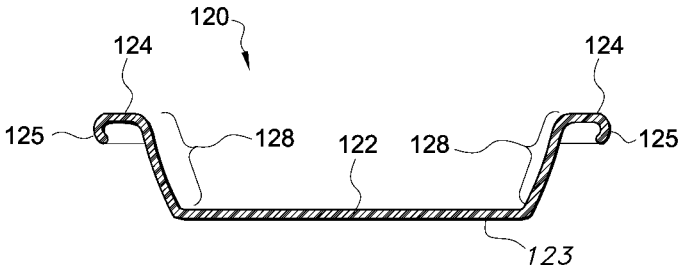
FIG. 11 depicts a cross-sectional view of a first upper bowl.
Figure 12:
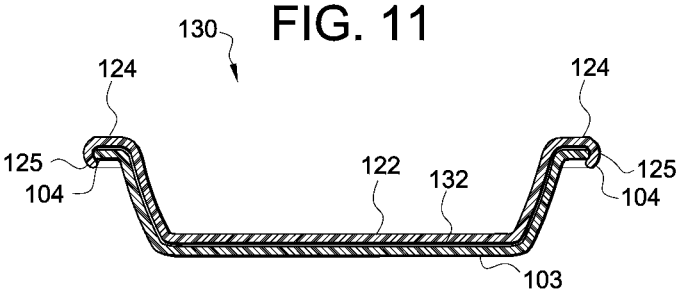
FIG. 12 depicts a cross-sectional view of a nested first upper bowl with a second lower bowl with a design insert introduced between both bowls.

FIGS. 10-16 show the same basic display method but for nesting bowl articles. FIG. 10 shows a lower bowl 100 having a peripheral edge (rim) 104, an incline 108, a well surface 102, and a lower surface 103. FIG. 11 shows the overall article 130 including an upper transparent bowl 120 having a rim 124, an extended lip peripheral edge 125, an incline 128, a well surface 122, and a lower surface 123. FIG. 12 shows these two bowls (100, 120 of FIGS. 10 and 11) nested together with an insert 132 placed between the well surfaces 103, 122. The upper bowl extended peripheral lip 125 flexes during connection to suitably hold the lower bowl peripheral edge 104.

Figure 13:
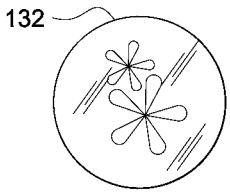
FIG. 13 depicts an aerial view of one non-limiting design insert for utilization with the bowls of FIGS. 10 and 11.
Figure 14:
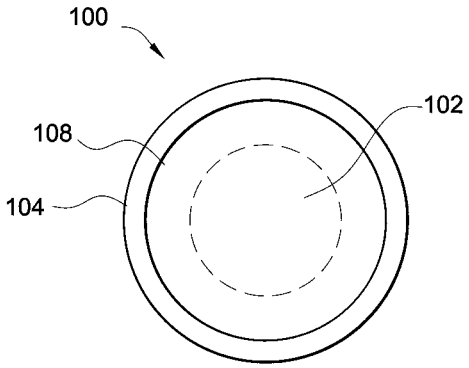
FIG. 14 depicts an aerial view of the second lower bowl of FIG. 10.
Figure 15:
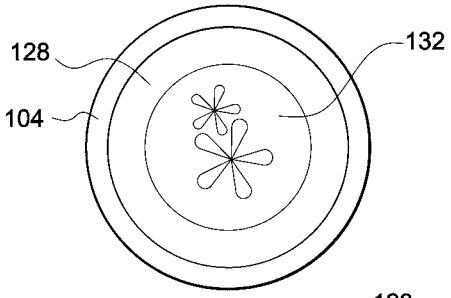
FIG. 15 depicts an aerial view of the placement of the design insert of FIG. 13 on to the upper surface of the well of the second lower bowl of FIG. 14.
Figure 16:
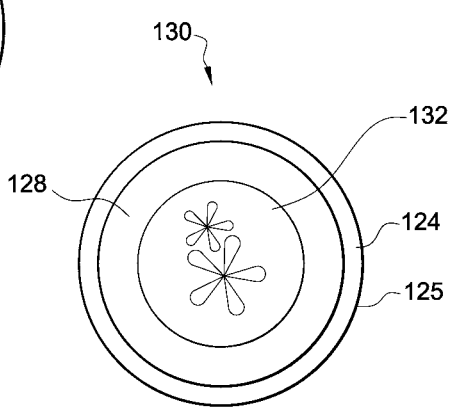
FIG. 16 depicts an aerial view of the placement of the first upper bowl of FIG. 11 on to the lower bowl/insert article of FIG. 15.

FIG. 13 shows one non-limiting embodiment of a design insert 132 for introduction between the two bowls (100, 120 of FIGS. 10 and 11). In this situation, a simple floral pattern is provided on the insert 132. FIG. 14 shows the lower bowl 100 (the same as in FIG. 10) with the well surface 102, the peripheral edge 103, and the incline 108. FIG. 15 shows the insert 132 placed on top of the well surface (102 of FIG. 14) of the lower bowl 100. FIG. 16 thus shows an aerial view of the entire display article 130 with the upper bowl 120 placed over the insert 132 (which is viewable through the upper bowl 120), with the extended lip peripheral edge 125 over the peripheral edge of the lower bowl (104 of FIG. 15) to resiliently connect the two bowls together.

Figure 17:
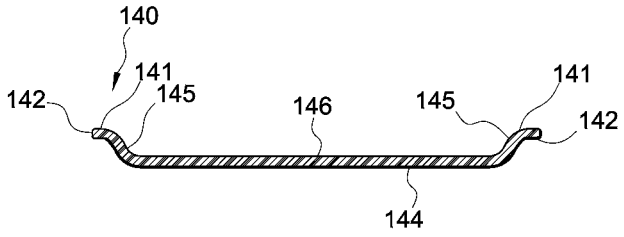
FIG. 17 depicts a cross-sectional view of a second lower tray in accordance with one potential embodiment of the invention.
Figure 18:
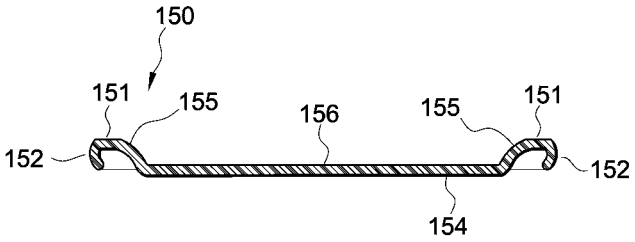
FIG. 18 depicts a cross-sectional view of a first upper tray.
Figure 19:
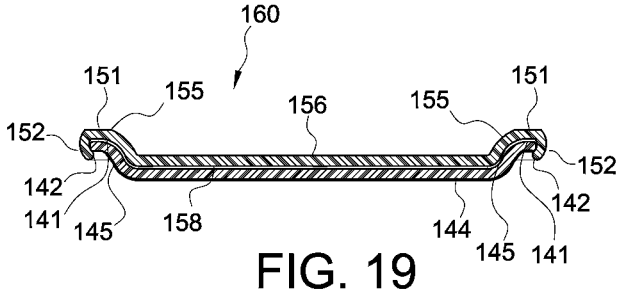
FIG. 19 depicts a cross-sectional view of a nested first upper tray with a second lower tray with a design insert introduced between both tray.

FIGS. 17-23 show the same basic display method but for nesting tray articles. FIG. 17 shows a lower tray 140 having a rim 141, a peripheral edge 142, an incline 145, a well surface 146, and a lower surface 144. FIG. 18 shows an upper transparent tray 150 having a rim 151, an extended lip peripheral edge 152, an incline 155, a well surface 156, and a lower surface 154. FIG. 19 shows the overall article 160 with these two trays (140, 150 of FIGS. 17 and 18) nested together with an insert 158 placed between the well surfaces 146, 154. The upper tray extended peripheral lip 152 flexes during connection to suitably hold the lower tray peripheral edge 142.

Figure 20:
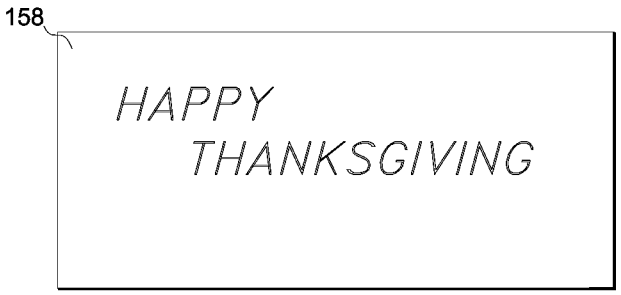
FIG. 20 depicts an aerial view of one non-limiting design insert for utilization with the trays of FIGS. 17 and 18.
Figure 21:
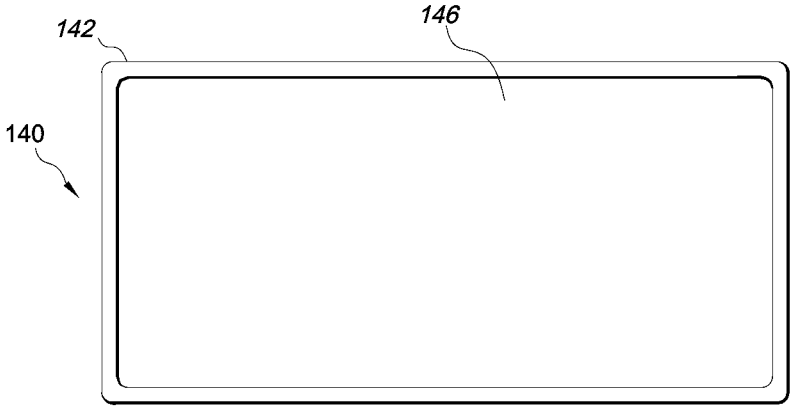
FIG. 21 depicts an aerial view of the second lower tray of FIG. 17.
Figure 22:
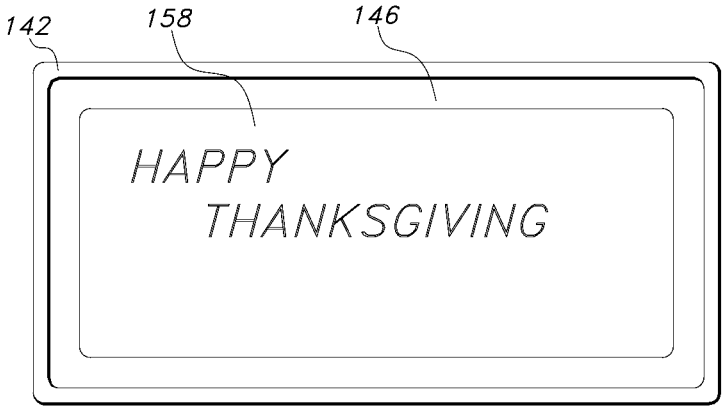
FIG. 22 depicts an aerial view of the placement of the design insert of FIG. 20 on to the upper surface of the well of the second lower tray of FIG. 21.
Figure 23:
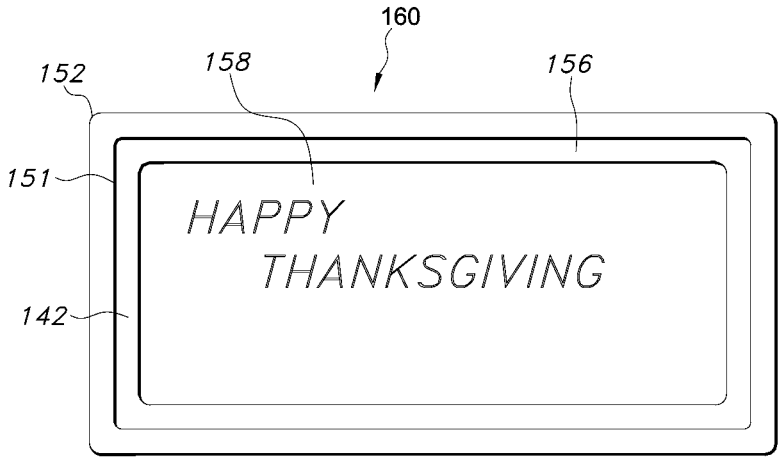
FIG. 23 depicts an aerial view of the placement of the first upper tray of FIG. 18 on to the lower tray/insert article of FIG. 22.

FIG. 20 shows one non-limiting embodiment of a design insert 158 for introduction between the two trays (140, 150 of FIGS. 17 and 18). In this situation, a HAPPY THANKSGIVING greeting is provided on the insert 158. FIG. 21 shows the lower tray 140 (the same as in FIG. 17) with the well surface 146 and the peripheral edge 142. FIG. 22 shows the insert 158 placed on top of the well surface 146 of the lower tray 140. FIG. 23 thus shows an aerial view of the entire display article 160 with the upper tray 150 placed over the insert 158 (which is viewable through the upper tray 150), with the extended lip peripheral edge 152 over the peripheral edge of the lower bowl (142 of FIG. 17) to resiliently connect the two bowls together.

Thus, the overall display article, method, and system permits a user the full complement of the expanse of a plate, bowl, tray, basically any type of dinnerware implement with which to provide a temporary, interchangeable, insert of any design that is viewable through at least the upper dinnerware component itself. The upper component plate must be transparent in its entirety to effectuate such a result, with a proper connection means between the two components to allow for full range of use upon a reliable connection there between. The lower component may be transparent as well, if desired, and as potentially preferred. Furthermore, the two dinnerware components may not only be easily and safely cleaned within a dishwasher for further use, but both components may actually be utilized separately as implements on their own if such a need arises. This versatility, then, of providing such an effective display article with all the other benefits accorded therein, is highly unexpected and of great utility.

Having described the invention in detail it is obvious that one skilled in the art will be able to make variations and modifications thereto without departing from the scope of the present invention. Accordingly, the scope of the present invention should be determined only by the claims appended hereto.

I claim:

1. A display plate comprising a first upper component and a second lower component wherein said first and second components are configured to have substantially the same contours for said components to properly nest together upon placement of said upper component on top of said lower component and upon introduction of an insert between said upper and said lower component, wherein said first upper component is constructed of a transparent polymeric material such that said insert may be placed at any location under said first upper component and properly viewed throughout the entirety of said first upper component when present between said first upper component and said second lower component, wherein said first upper component includes a well portion, a peripheral edge portion having an extended downward lip, a rim portion, and a frame portion inclined to said well portion, each portion having a top surface and a bottom surface, wherein said second lower component includes a well portion, a peripheral edge portion with an end that fits within said first upper component extended downward lip, a rim portion, and a frame portion inclined to said well portion, each portion having a top surface and a bottom surface, wherein the well portions of said first upper and second lower components are flat such that said bottom surface of said second lower component well portion provides the sole base of said display plate to rest on a flat surface and wherein the entirety of both flat well portions are parallel such that an interstitial space of between 1 and 20 mils is present between said flat well portions when said first upper and second lower components are nested together, wherein said bottom surface of said second lower component well portion resides within a single plane and no other portion of said second lower component resides within the same or a lower plane, wherein the incline from said first upper component frame to said first upper component well exhibits a higher incline angle than the incline from said second lower component frame to said second lower component well, wherein said extended downward lip of said peripheral edge of said first upper component extends to a point below that of the peripheral edge of said second lower component when said first component and said second component are contacted in nesting relation to one another such that said first and second components are attached in detachable fashion solely through pressure contact between said peripheral edges, wherein said insert may be of any design and shape that does not reach beyond the bounds of said peripheral edges of both of said first upper and said second lower components, and wherein each of said first upper component and said second lower component may be reusable for the same display purpose.

2. The article of claim 1 wherein said second lower component is constructed of the same material as the first upper component.

3. A method of permitting the interchangeable introduction of an insert for viewing between two separate components within a dinnerware plate, wherein such method includes:

providing a first upper plate component, wherein said first upper component is transparent to permit full viewing of said insert when viewed through such first upper component, wherein said first upper component has a well portion, a peripheral edge portion having an extended downward lip, a rim portion, and a frame portion inclined to said well portion, each portion having a top surface and a bottom surface;

providing a second lower plate component having a well portion, a peripheral edge portion with an end that fits within said first upper component extended downward lip, a rim portion, and a frame portion inclined to said well portion, each portion having a top surface and a bottom surface;

wherein the well portions of said first upper and second lower components are flat such that said bottom surface of said second lower component well portion provides the sole base of said display plate to rest on a flat surface and wherein the entirety of both flat well portions are parallel such that an interstitial space of between 1 and 20 mils is present between said flat well portions when said first upper and second lower components are nested together;

wherein said bottom surface of said second lower component well portion resides within a single plane and no other portion of said second lower component resides within the same or a lower plane;

wherein the incline from said first upper component frame to said first upper component well exhibits a higher incline angle than the incline from said second lower component frame to said second lower component well, wherein said extended downward lip of said peripheral edge of said first upper component extends to a point below that of the peripheral edge of said second lower component when said first component and said second component are contacted in nesting relation to one another such that said first and second components are attached in detachable fashion solely through pressure contact between said peripheral edges with minimal space available for insertion of an insert between said first upper component and said second lower component at any location between said components;

providing a solid insert of any design and shape that does not reach beyond the bounds of said peripheral edges of both of said first upper and said second lower components;

placing said solid insert on top of said second lower component and at any location thereon;

placing said first upper component on top of said second lower component on which said insert is placed; and connecting said first upper component to said second lower component through the overlapping contact of said peripheral edges, wherein said insert is properly viewed through said upper first component, and said connected components may be utilized as a single dinnerware article simultaneously with said viewing.

* * * * *